US005775284A

United States Patent [19]

Kirchner et al.

[11] Patent Number: 5,775,284

[45] Date of Patent: Jul. 7, 1998

[54] TWO-PIECE VALVE STEM SEAL

[75] Inventors: Karry S. Kirchner; Milton L. Griswold, both of Gainesville, Ga.

[73] Assignee: Freudenberg-NOK General Partnership, Plymouth, Mich.

[21] Appl. No.: 852,836

[22] Filed: May 7, 1997

[51] Int. Cl.[6] ..... F01L 3/08

[52] U.S. Cl. ..... 123/188.6; 123/90.37

[58] Field of Search ..... 123/188.6, 188.9, 123/188.12, 188.13, 90.37

[56] References Cited

U.S. PATENT DOCUMENTS

| | | | |
|---|---|---|---|
| 3,480,286 | 11/1969 | Kosatka | 123/188.6 |
| 3,699,942 | 10/1972 | Moray | 123/188.6 |
| 3,782,684 | 1/1974 | Stephens et al. . | |
| 4,811,960 | 3/1989 | Stritzke et al. | 123/188.6 |
| 4,826,180 | 5/1989 | Deuring . | |
| 4,909,202 | 3/1990 | Binford et al. | 123/188.6 |
| 4,928,644 | 5/1990 | Travis | 123/90.37 |
| 4,947,811 | 8/1990 | Binford | 123/188.6 |
| 5,002,018 | 3/1991 | Strout . | |
| 5,062,397 | 11/1991 | Larson . | |
| 5,067,449 | 11/1991 | Bonde . | |
| 5,110,142 | 5/1992 | Szott . | |
| 5,129,624 | 7/1992 | Icehower et al. . | |
| 5,174,256 | 12/1992 | Binford | 123/188.6 |
| 5,237,971 | 8/1993 | Worsley . | |
| 5,472,216 | 12/1995 | Albertson et al. . | |
| 5,558,056 | 9/1996 | Sakata | 123/188.6 |

*Primary Examiner*—Erick R. Solis
*Attorney, Agent, or Firm*—Dinnin & Dunn, P.C.

[57] ABSTRACT

A two piece valve stem seal assembly including a first rigid cylindrical shell having a flange portion and an end wall at a top portion. The valve stem seal assembly also includes a second rigid cylindrical shell having an outwardly radially extending seat portion and an inner radially extending flange. The valve stem seal assembly also including a resilient sealing body directly bonded with said first rigid cylindrical shell.

16 Claims, 2 Drawing Sheets

TWO-PIECE VALVE STEM SEAL

BACKGROUND OF THE INVENTION

1. Field of the Invention

The present invention relates to valve stem seals, and more particularly to a two-piece valve stem seal for use in an internal combustion engine.

2. Description of Related Art

Valve stem seals are known in the art as shown in U.S. Pat. No. 4,947,811; U.S. Pat. No. 4,909,202; U.S. Pat. No. 3,554,562; U.S. Pat. No. 5,558,056; and U.S. Pat. No. 3,554,180. The valve stem seals function is to (1) meter oil to provide adequate lubrication at the valve stem/valve guide interference and (2) minimize internal oil consumption.

Generally speaking a valve stem seal assembly includes a rigid shell to secure a seal body on a valve stem guide, with the inside diameter of the shell engaging the outside diameter of the guide. The shell usually supports a sealing element which is centered about the valve stem in order to meter the oil that lubricates the guide inner diameter valve stem interface yet minimizes the amount of oil being drawn into a combustion chamber or exhaust chamber. If the rigid shell is not properly placed in relation to the valve guide the sealing element might not properly seat upon the valve stem thus causing non-uniform pressures at the cylinder and valve guide, undesirable wear patterns on the seal or valve stem and unpredictable oil control for the valve stem.

Previous valve stem seals have had histories of cracked flanges during vehicle operations because of the accumulation of shock waves and internal stresses at the flange portion of the valve stem seal. Previous valve stem seals also had trouble creating a flat flange which increases the likelihood of flange cracking.

Therefore, there is a need in the art for a valve stem seal that will overcome the many disadvantages of the prior art.

SUMMARY OF THE INVENTION

One object of the present invention is to provide an improved two-piece valve stem seal.

Another object of the present invention is to provide a valve stem seal which will offer greater resistance to the forces exerted by the valve spring which causes the flange to crack.

A further object of the present invention is the heat treated metal flange will prevent the sealing member of the assembly from separating from the valve guide.

Yet a further object of the present invention is to provide a flanged valve stem seal that will not rotate about the valve guide due to the rotational motion of the valve spring. This will eliminate the torsional stresses the spring lip would otherwise experience, thereby reducing wear and extending product life.

To achieve the fore going objects the improved two-piece valve stem seal includes a rigid cylindrical shell. The valve stem seal further includes a resilient rubber sealing body which is bonded directly to the metal casing. The sealing member also has an interference fit with the heat treated metal flange. The sealing member of the present invention will be stationary which will reduce seal lip wear and extend product life.

One advantage of the present invention is that a bonded resilient seal is used which creates easier seal installation and removal, greater support of the sealing lip and superior control of oil metering for lubrication of the valve stem.

A further advantage of the present invention is that no abrasion of the valve guide occurs during seal installation and oil leakage through the interior of the seal is eliminated.

A further advantage of the present invention is that the problem of the flange cracking will be reduced for the valve stem seal.

Other objects, features and advantages of the present invention will become apparent from the subsequent description and appended claims taken in conjunction with the accompanying drawings.

Figure 1:
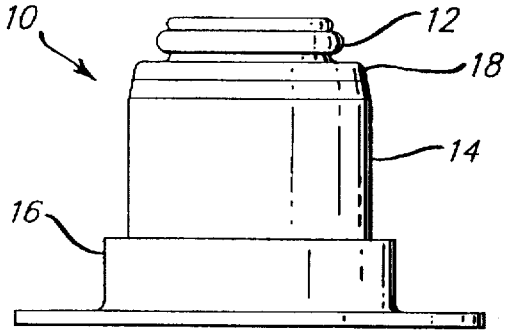
FIG. 1 shows a plan view of the present invention.
Figure 2:
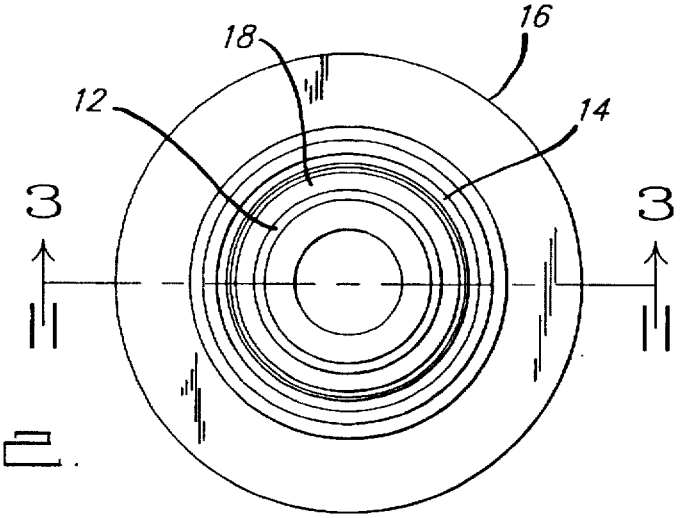
FIG. 2 shows a cross-section of the valve stem seal taken along line 3—3.
Figure 3:
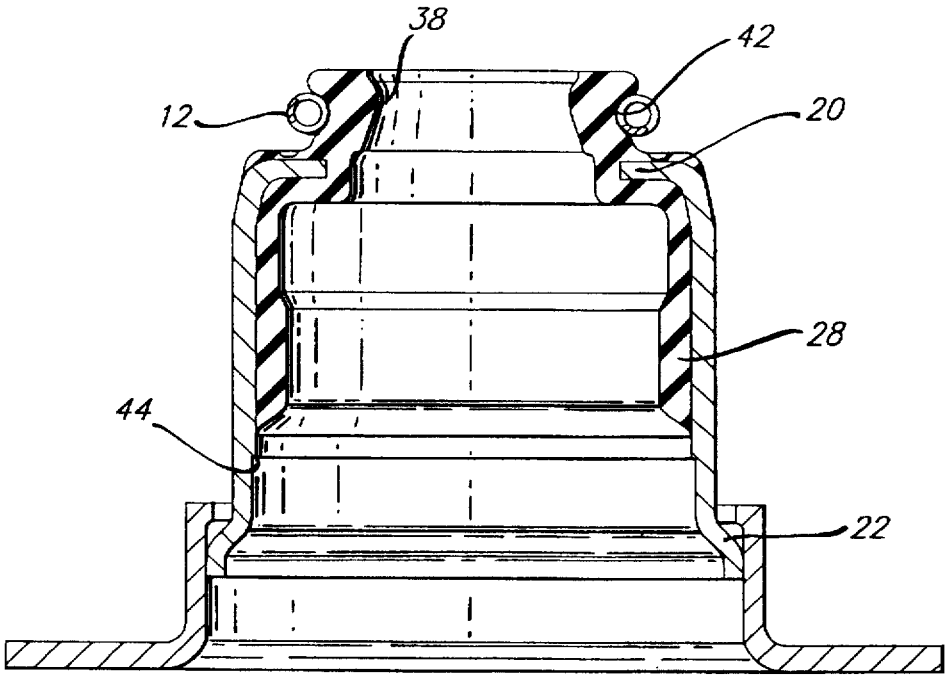
FIG. 3 shows a cross-section of the valve stem seal.
Figure 4:
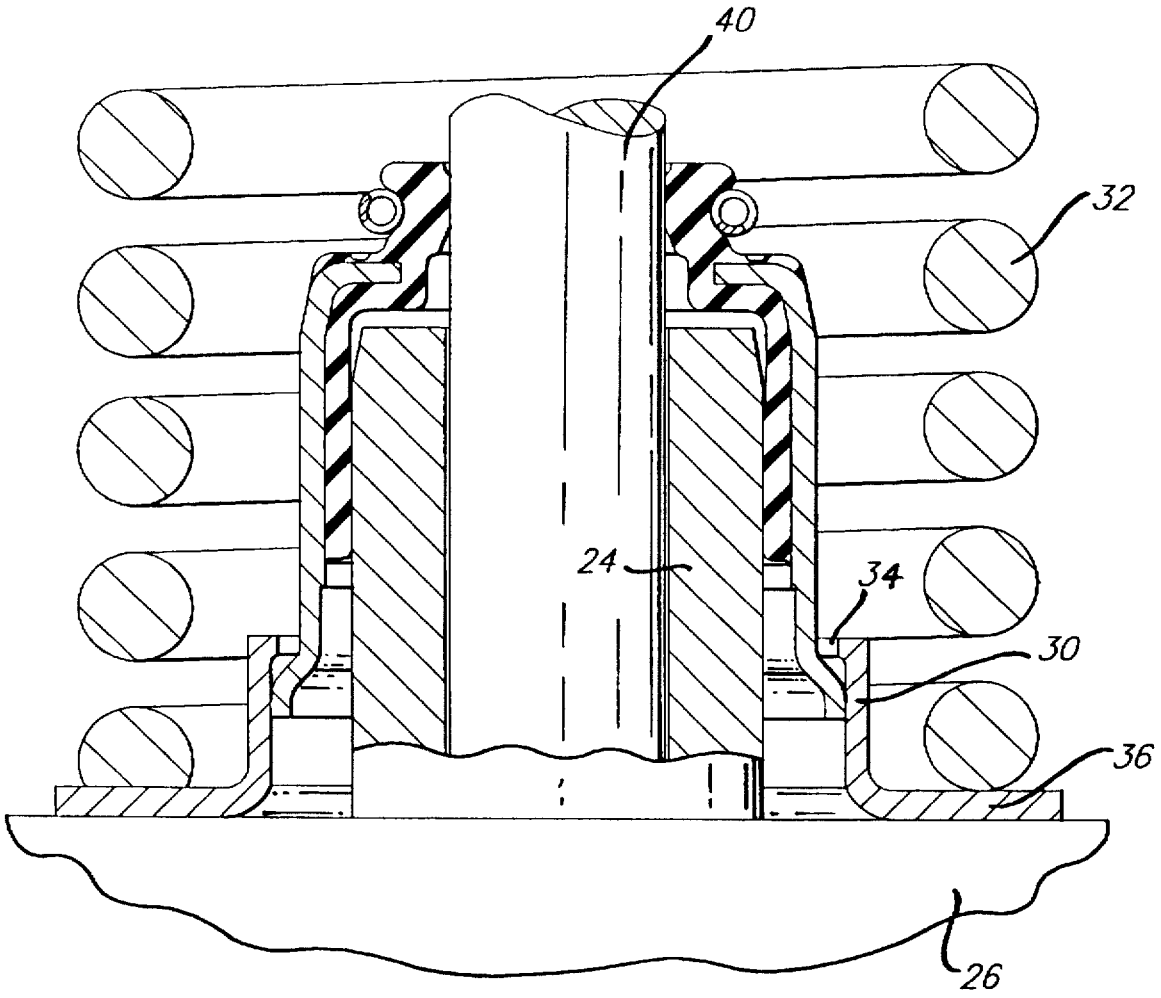
FIG. 4 shows a cross-section of the valve stem seal in operation.

BEST MODE IN CARRYING OUT THE INVENTION AND DESCRIPTION OF THE PREFERRED EMBODIMENT(S)

Referring to the drawings, a two-piece valve stem seal assembly 10 is shown. The valve stem seal assembly 10 has a two-piece construction. The two-piece construction includes a rigid shell 14 which is preferably made of a metal material but may be made of a ceramic or any other hard rigid material available. The rigid shell 14 is also preferably cylindrical in shape but any other shape may be used depending on the needs of the specific application for the valve stem seal assembly. The valve stem seal assembly 10 also includes a resilient sealing body 18 which is directly bonded to the rigid cylindrical shell 14. The rigid cylindrical shell 14 is in contact with a second rigid shell 16. The second rigid shell 16 is preferably made of a metal material but may be made of a ceramic or any other type of rigid material available. The second rigid shell 16 is also preferably cylindrical in shape but any other shape may be used depending on the needs of the specific application for the valve stem seal assembly. It should be noted that the resilient sealing body 18 is preferably made of a rubber material but may be made of any other resilient rubber or plastic type material capable of providing a seal. In the preferred embodiment the rigid cylindrical shell 14 has an interference fit with the second rigid shell 16 but it should be noted that other types of connection or bonding may be used such as welding, direct forging, or any other type of bonding or connecting means available. The rigid cylindrical shell 14 includes an inwardly extending end wall 20. The rigid cylindrical shell 14 also includes an outwardly projecting flange 22 at an end thereof. The rigid cylindrical shell 14 further includes an outward step 44 on an inner surface of the shell 14.

The resilient sealing body 18 is directly molded to the end wall 20 of the rigid cylindrical shell 14. The resilient sealing body 18 may be molded to the end wall 20 such that it will completely surround the end wall 20. However, different molding variations may be used in connecting the sealing body 18 to the rigid cylindrical shell 14. It should be noted that other methods may be used such as interference fits, epoxies or any other methods capable of creating a fixed joint between the cylindrical shell 14 and the resilient body 18. The rubber pad 28 is also molded onto the interior wall of the rigid cylindrical shell 14 and is in contact with the valve guide 24 upon insertion into an automotive cylinder head or engine block 26. The rigid cylindrical shell 14 has an interference fit with the second cylindrical shell 16 and creates a retaining force to urge the rubber pad 28 into constant contact with the valve guide assembly 24. The vertical wall 30 of the second rigid cylindrical shell 16 will eliminate any possibility of the sealing member of the valve stem assembly separating from the valve guide 24 during operation of the vehicle. The second rigid shell 16 also provides a barrier of protection which protects the valve spring 32 from wearing into the cylinder head 26 during operation.

The second cylindrical shell 16 also includes an inwardly extending flange 34. The second cylindrical shell 16 also includes a metal flange or seat 36 which is in direct contact with the engine block head 26 and is the seat for the valve spring 32 such that the valve spring 32 will not wear into the cylinder head during vehicle operation. The second rigid cylindrical shell 16 is manufactured separately from the rigid cylindrical shell 14 of the valve stem seal assembly 10. This separate manufacturing method makes it possible to reduce the occurrence of internal stresses in the second rigid cylindrical shell 16. This also allows the second rigid cylindrical shell flange 36 to have a flatness that can be more accurately controlled which in turn will reduce the frequency of flange cracking which has been a common problem for valve stem seals of this type. However, with the second rigid cylindrical shell 16 manufactured separately from the first rigid cylindrical shell 14 and sealing body 18, after initial manufacturing procedures for the separate pieces they will have to be assembled into the valve stem seal assembly 10 for use in the automotive engine.

The resilient sealing body 18 also includes an annular sealing lip 38 at its top portion which provides a constant seal with the valve stem 40 during vehicle operation. The resilient sealing body 18 also includes a concave groove 42 along the upper portion of the resilient seal body 18. The concave groove 42 receives and holds in position a spring member 12 which will further urge the resilient annular sealing lip 38 into constant contact with the valve stem 40 during vehicle operation. This spring 12 and the annular sealing lip 38 will control the amount of oil between the valve stem 40 and the valve stem seal assembly 10.

In operation, prior art valve stem seal assembles were forced to rotate by the valve spring during operation of the motor vehicle. This would subject the sealing lip to torsional stresses, as well as axial forces from the reciprocating valve stem during the operation of the vehicle. However, with the preferred embodiment of the current valve stem seal assembly 10 during engine operation the first cylindrical rigid shell 14 is separated from the second rigid cylindrical shell 16 which will allow the second rigid cylindrical shell 16 to rotate with the valve spring 12 instead of the entire valve stem assembly 10 rotating with the valve spring 12. This will result in the sealing member 18 being stationary in relation to the valve stem 40, i.e. not rotating around the valve stem 40. This will in turn reduce seal lip wear and extend the product life of the valve stem seal assembly 10. Greater control of oil metering throughout the life of the seal will also be easier to accomplish if the entire valve stem seal 10 does not rotate. The valve stem seal assembly 10 is installed as one unit because of the interference fit between the first rigid cylindrical shell 14 and the second rigid cylindrical shell 16. Separation of the first rigid cylindrical shell 14 from the second rigid cylindrical shell 16 will occur only during engine operation thus allowing only the second rigid cylindrical shell 16 to rotate while the first cylindrical shell 14 and sealing body 18 are stationary about the valve stem 40.

The present invention has been described in an illustrative manner, it is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise then as specifically described.

What is claimed is:

1. A valve stem seal assembly for use in an internal combustion engine, said assembly including:

a first rigid cylindrical shell having a radially inwardly extending flange at a top end of said shell and an outwardly extending flange at a bottom end of said shell;

a second rigid cylindrical shell having an outwardly extending seat at a bottom end thereof and an inwardly radially extending flange at a top end thereof, said first rigid cylindrical shell in contact with an inner surface of said second rigid cylindrical shell;

a resilient sealing body in contact with said first rigid cylindrical shell, said resilient sealing body in constant contact with a valve stem; and a spring having a circumferential shape, said spring used to urge the resilient sealing body in contact with the valve stem.

2. The valve stem seal assembly of claim 1 wherein said first rigid cylindrical shell is made of a metal material.

3. The valve stem seal assembly of claim 1 wherein said second rigid cylindrical shell is made of a metal material.

4. The valve stem seal assembly of claim 1 wherein said resilient sealing body is made of a rubber material.

5. The valve stem seal assembly of claim 1 further including an annular sealing lip at a top portion of said resilient sealing body.

6. The valve stem seal assembly of claim 1 wherein said resilient seal body is bonded directly to the first rigid cylindrical shell.

7. A valve stem seal assembly for use in an internal combustion engine, said assembly including:

a first rigid cylindrical shell having a radially inwardly extending flange at a top end of said shell and an outwardly extending flange at a bottom end of said shell;

a second rigid cylindrical shell having an outwardly extending seat at a bottom end thereof and an inwardly radially extending flange at a top end thereof, said first rigid cylindrical shell in contact with an inner surface of said second rigid cylindrical shell, said first cylindrical shell and said second cylindrical shell are connected via an interference fit; and a resilient sealing body in contact with said first rigid cylindrical shell, said resilient sealing body in constant contact with a valve stem.

8. The valve stem seal assembly of claim 7 wherein said interference fit allows for said second cylindrical rigid shell to rotate with a valve spring while said first rigid cylindrical shell is stationary in rotational relation to the valve spring.

9. A valve stem seal assembly for use in a internal combustion engine, said assembly including:

a first rigid cylindrical shell having a radially inwardly extending end wall at a top end of said shell, said first rigid cylindrical shell having an outwardly extending flange at a bottom end of said shell;

a second rigid cylindrical shell having an outwardly radially extending seal seat at a bottom end of said shell, said second rigid cylindrical shell having an inwardly radially extending flange at a top end of said second rigid shell;

said first rigid cylindrical shell in contact with an inner wall of said second rigid cylindrical shell;

a resilient sealing body bonded to said first rigid cylindrical shell, said resilient seal body includes an annular sealing lip at a top portion of said resilient seal body, said resilient seal body includes an annular raised portion at a bottom end of said resilient seal body, said resilient seal body in constant contact with a valve guide and a valve stem.

10. The valve stem seal assembly of claim 9 wherein said first rigid cylindrical shell is made of metal.

11. The valve stem seal assembly of claim 9 wherein said second rigid cylindrical shell is made of metal.

12. The valve stem seal assembly of claim 9 wherein said seal body is made of a rubber material.

13. The valve stem seal assembly of claim 9 further including a ring spring.

14. The valve stem seal assembly of claim 9 wherein said second cylindrical shell rotates independent of said first cylindrical shell.

15. The valve stem seal assembly of claim 14 wherein said second cylindrical shell is a seat for a valve spring.

16. The valve stem seal assembly of claim 15 wherein said second cylindrical shell rotates with said valve spring.

* * * * *